United States Patent [19]

Yamada et al.

[11] 4,449,992

[45] May 22, 1984

[54] HEAT-AND-MOISTURE EXCHANGER

[75] Inventors: Takeyoshi Yamada; Shizuka Kurisu; Shizuo Azuma, all of Iwakuni; Shoji Kawase, Koganei; Makoto Sano, Iwakuni, all of Japan

[73] Assignee: Teijin Limited, Osaka, Japan

[21] Appl. No.: 222,548

[22] Filed: Jan. 5, 1981

Related U.S. Application Data

[63] Continuation of Ser. No. 54,405, Jul. 3, 1979, abandoned.

[30] Foreign Application Priority Data

Dec. 14, 1978 [JP] Japan ..... 53-153722

[51] Int. Cl.[3] ..... B01D 53/22

[52] U.S. Cl. ..... 55/158; 55/196

[58] Field of Search ..... 55/16, 34, 158, 159, 55/181, 196, 387, 390; 165/7, 8, 10, 166, DIG. 8, DIG. 10; 264/41

[56] References Cited

U.S. PATENT DOCUMENTS

| | | | |
|---|---|---|---|
| 3,426,754 | 2/1969 | Bierenbaum et al. | 264/41 X |
| 3,666,007 | 5/1972 | Yoshino et al. | 165/166 |
| 3,679,538 | 7/1972 | Druin et al. | 264/41 X |
| 3,839,240 | 10/1974 | Zimmerman | 264/41 X |
| 3,843,761 | 10/1974 | Bierenbaum et al. | 264/41 X |
| 3,844,737 | 10/1974 | Macriss et al. | 55/390 X |
| 3,925,021 | 12/1975 | Yoshino et al. | 165/166 X |
| 4,051,898 | 10/1977 | Yoshino et al. | 165/166 |

FOREIGN PATENT DOCUMENTS

| | | | |
|---|---|---|---|
| 2414663 | 11/1974 | Fed. Rep. of Germany | 55/390 |
| 48-45951 | 6/1973 | Japan | 165/166 |
| 49-45882 | 5/1974 | Japan | 55/388 |
| 51-2131 | 1/1976 | Japan | 55/388 |
| 52-10214 | 3/1977 | Japan | 165/166 |

*Primary Examiner*—Robert H. Spitzer

*Attorney, Agent, or Firm*—Sherman & Shalloway

[57] ABSTRACT

A heat-and-moisture exchanger including a thin film-like porous material as a partitioning element for heat and moisture exchanges between two gases, said porous material containing numerous pores having an average diameter of not more than 5 microns and opened to both surfaces thereof, and having a thickness of not more than 500 microns, a specific surface area of at least 0.3 $m^2/g$, and a gas permeability having a value of at least 50 seconds/100 cc. This heat-and-moisture exchanger is used in a ventilating device and an air-conditioner.

8 Claims, 14 Drawing Figures

HEAT-AND-MOISTURE EXCHANGER

Figure 1:
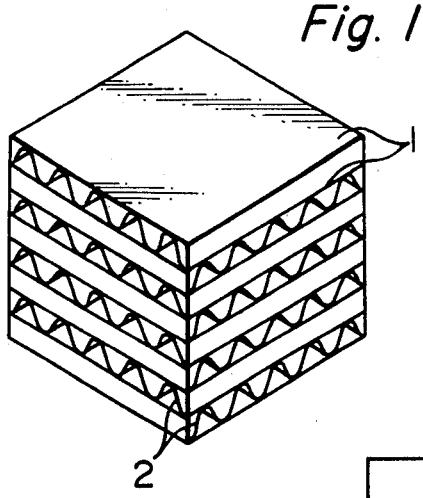

This is a continuation of application Ser. No. 054,405, filed July 3, 1979, now abandoned.

This invention relates to a heat-and-moisture exchanger. More specifically, this invention relates to a heat-and-moisture exchanger which exhibits excellent moisture and heat exchange efficiencies and which substantially retains its excellent exchange efficiencies even when the flow rates of gases are varied within ordinary ranges of flow rate.

In many commercial and residential buildings, it has recently been the general practice to create a more pleasant living environment by air-conditioning them throughout the year. In this situation, the rooms are normally shut during the operation of an air-conditioning system, and the indoor air will be gradually staled and polluted. It is necessary therefore to refresh the indoor air occasionally by, for example, opening the windows to admit fresh outdoor air. However, such a method of exchanging air will destroy the properly controlled indoor temperature and/or humidity, and temporarily cause a loss of the pleasant indoor environment. Furthermore, to adjust the temperature and humidity of the admitted outdoor air to those of the indoor air, the air-conditioning system should be operated with higher energy.

As a solution to this problem, a heat-and-moisture exchanger was developed in which moisture-and-heat exchange is effected between the fresh but humid and/or hot air taken from outdoors and the cold stale indoor air to be discharged during the operation of a cooler, thus producing the same effect as the admitting of cold refresh outdoor air. This heat-and-moisture exchanger can be equally used during the operation of a heater, and in this case, the fresh cold air to be taken indoors acquires moisture and heat from the stale warm indoor air to be discharged, thus producing the same effect as the admitting of fresh warm air. In this way, the heat-and-moisture exchange has the function of simultaneously exchanging heat between the discharged air and the admitted air (exchange of heat) and moisture between these airs (exchange of latent heat expressed as the exchange of the heat of evaporation possessed by the moisture).

As a partitioning element for partitioning two kinds of air currents in the conventional heat-and-moisture exchanger, there have been suggested Japanese paper or asbestos paper (U.S. Pat. Nos. 4,051,898 and 3,666,007), Japanese paper impregnated lithium compound such as lithium chloride (Japanese Patent Publication No. 2131/76), and hydrophilic polymeric films (Japanese Patent Publication No. 10214/77).

Heat-and-moisture exchangers including Japanese paper, asbestos paper, or Japanese paper impregnated with the lithium compound as a partitioning element have a fairly satisfactory moisture permeability, but have the defect of being highly permeable to gases.

Specifically, during heat-and-moisture exchange, the indoor air polluted by odors, carbon monoxide, carbon dioxide, etc. generated by cigarette smoking or from cooking gas stoves, etc. gets mixed with the fresh outdoor air to be admitted indoors and flows back indoors, thus markedly preventing cleaning of the indoor air.

One possible way of removing such a defect is to increase the thickness of the partitioning element. This would, however, tend to reduce the heat-exchanging ability and moisture permeability of the exchanger and to greatly aggravate the efficiency of exchange.

When the partitioning element is Japanese paper, the exchanger is subject to the restrictions attributed to the inherent nature of the paper. It is practically impossible to wash the partitioning element made of Japanese paper for removing soiling because even with utmost care taken in washing it, drying will lead to deformation or detachment of the bonded parts.

The partitioning element made of Japanese paper impregnated with the lithium compound, when washed with water for the aforesaid purpose, would result in the dissolving of the lithium compound in water. For this reason alone, this partitioning element cannot virtually be washed with water.

The partitioning element made of asbestos paper is not entirely free from the possibility of scattering of asbestos powder in the air. This is likely to pose a new problem because asbestos is notoriously carcinogenic.

The partitioning element made of a hydrophilic polymeric film generally has a lower gas permeability than those made of paper, etc. Hence, it has the superior ability to clean the air, and can be washed with air. However, it has the defect of possessing a low moisture permeability, and the low ability to exchange latent heat.

In addition, conventional heat-and-moisture exchangers including the aforesaid partitioning elements made of paper, asbestos paper, paper impregnated with lithium compounds, and polymeric films have the common defect that when the amount of air to be exchanged increases beyond a certain limit, the efficiencies of moisture and heat exchanges gradually decrease.

It is an object of this invention therefore to provide a heat-and-moisture exchanger having excellent efficiencies of moisture and heat exchanges.

Another object of this invention is to provide a heat-and-moisture exchanger having an outstanding exchange ability which does not appreciably decrease even when the flow rates of exchanging gases are increased.

Still another object of this invention is to provide a heat-and-moisture exchanger which exchanges moisture and heat with a good efficiency, but has a low permeability to air, carbon dioxide, carbon monoxide, etc., thus exhibiting superior ventilating properties.

A further object of this invention is to provide a heat-and-moisture exchanger which retains its superior exchange efficiencies even when washed with water, and therefore can be maintained clean by a simple procedure of washing.

Other objects and advantages of this invention will become more apparent from the following description.

These objects and advantages can be achieved in accordance with this invention by a heat-and-moisture exchanger including a thin film-like porous material as a partitioning element for heat and moisture exchanges between two gases, said porous material containing numerous pores having an average diameter of not more than 5 microns and opened to both surfaces thereof, and having a thickness of not more than 500 microns, a specific surface area of at least 0.3 $m^2/g$, and a gas permeability having a value of at least 50 seconds/100 cc.

The thin film-like porous material used as a partitioning element in the heat-and-moisture exchanger of this invention has the following properties.

(1) It has a thickness of not more than 500 microns.

(2) It contains numerous pores having an average diameter of not more than 5 microns which are opened to both surfaces thereof.

(3) It has a specific surface area of at least 0.3 $m^2/g$.

(4) It has a gas permeability having a value of at least 50 seconds/100 cc.

These four properties characterizing the thin film-like porous material correlate to each other to provide the heat-and-moisture exchanger of this invention. These properties are described in more detail hereinbelow.

The thin film-like porous material in accordance with this invention has a thickness of not more than 500 microns. The thickness of the porous material greatly affects the efficiencies of heat and moisture exchange, especially the efficiency of heat exchange, of the porous material. Generally, the efficiency of heat exchange increases with decreasing thickness of the porous material. From this standpoint, the thickness of the porous material is preferably not more than 200 microns, more preferably not more than 100 microns.

The thin film-like porous material having such a degree of thickness generally tends to have a decreased strength for shape retention as its thickness decreases. For reinforcing purposes, therefore, it may be used as a unitary structure with a reticulated or network structure. In this case, the thin film-like porous material consists of a reinforcing reticulated structure and one or two layers of the thin film-like porous material which is required to be reinforced, or is preferably reinforced.

The reinforced thin film-like porous material in this invention can be produced by separately preparing the reticulated structure and the thin film-like porous material, and then uniting them by bonding, or by a low degree of fusion, for example. Or it may be produced by impregnating the reinforcing reticulated structure with a dope of a polymeric material constituting the thin film-like porous material, and then drying the impregnated product. The latter is a simple and suitable method for producing a reinforced three-layered thin film-like porous material composed of two thin film-like porous materials as both surface layers and an interlayer of the reinforcing reticulated structure.

Thus, in a preferred embodiment, the present invention provides a reinforced thin film-like porous material consisting of two surface layers of a thin film-like porous material containing numerous pores with an average diameter of not more than 5 microns and an interlayer of a reticulated structure containing numerous pores with an average diameter of more than 5 microns, the numerous pores in the two surface layers communicating with one another through the pores of the reticulated structure.

The thin film-like porous material in this invention contains numerous pores having an average diameter of not more than 5 microns and being opened to both surfaces of the porous material.

For moisture exchange between gases, many pores should be opened to both surfaces of the thin film-like porous material. It has now been found as a result of the investigations of the present inventors that when the average diameter of the pores is adjusted to not more than 5 microns, the porous material is well permeable to heat and moisture, but does not permit transmission of the stale indoor air to such an extent as to pollute fresh outdoor air to be taken indoors. It has also been found that when a thin film-like porous material having an average diameter of more than 5 microns, especially more than 10 microns as in paper, is used, the amounts of air as well as heat and moisture which permeate the porous material increase, and therefore, the indoor air to be discharged gets mixed with fresh outdoor air and flows back indoors.

The numerous pores of the porous material preferably have an average diameter of not more than 2 microns.

The average diameter of the pores in this invention denotes that pore diameter which corresponds to the maximum value of the pore diameter distribution determined by a mercury penetration method to be described in detail hereinbelow. Thus, the diameter merely means the diameter of a pore assumed to have a circular cross section which is determined by a mercury penetration method. This does not necessarily mean that the pores in the present invention have a circular cross section. The cross section of a pore in the direction of the thickness of the porous material needs not to be uniform in the direction of the thickness of the porous material.

The thin film-like porous material in this invention has a specific surface area of at least 0.3 $m^2/g$. This means that the porous material in this invention contains numerous pores having an average diameter of not more than 5 microns. In other words, many pores having an average diameter of not more than 5 microns are dispersed preferably uniformly on the surface so that the porous material has the aforesaid surface area.

It has been found that by dispersing a number of pores having an average diameter of not more than 5 microns such that the porous material shows a specific surface area of at least 0.3 $m^2/g$, excellent efficiencies of heat and moisture exchanges, especially moisture exchange, can be obtained, and these exchange efficiencies do not appreciably decrease even when the flow rates of gases to be exchanged are increased.

The porous material in accordance with this invention preferably has a specific surface area of at least 0.5 $m^2/g$, more preferably at least 0.6 $m^2/g$.

The specific surface area used in this invention denotes the one measured by a nitrogen gas adsorption method to be described hereinbelow in detail.

The thin film-like porous material in accordance with this invention has a gas permeability having a value of at least 50 seconds/100 cc.

Larger gas permeability values show more difficult passage of a gas. Hence, the passage of a gas is easier as the gas permeability is lower. For example, a material having a gas permeability having a value of 50 seconds/100 cc permits easier passage of a gas than a material having a gas permeability having a value of 100 seconds/100 cc.

The film-like porous material in accordance with this invention which contains pores having an average diameter of not more than 5 microns and has a relatively low gas permeability does not contain pores having a relatively large pore diameter which facilitates entry of stale air to be discharged to an extent such that the passage of the stale air poses a problem. The presence of pores having a relatively large pore diameter makes it very easy to pass stale air therethrough. For this reason, the value of gas permeability of the thin film-like porous material in this invention is limited to at least 50 seconds/100 cc.

The thin film-like porous material in this invention has a gas permeability having a value of preferably at least 100 seconds/100 cc, more preferably at least 200 seconds/100 cc. If the value of gas permeability is too high, passage of moisture becomes difficult. Thus, the upper limit to the value of gas permeability is preferably 10,000 seconds/100 cc, especially preferably 5,000 seconds/100 cc.

The gas permeability value of the porous material in accordance with this invention is measured by applying a gas under a certain pressure to a thin film-like porous material having a certain predetermined area, and allowing the gas to permeate the porous material.

The thin film-like porous material having the four specified properties has the superior performances described hereinabove. Thus, the heat-and-moisture exchanger of this invention including this porous material exchanges heat and moisture with an excellent efficiency, but does not exchange air, carbon dioxide, carbon monoxide, etc., to an extent such that the pollution of the air to be taken indoors becomes a problem. In addition, the efficiency of exchange of heat and moisture is scarcely reduced even when the flow rates of gases to be exchanged are increased. These excellent heat and moisture exchange efficiencies, ventilating properties and exchange ability make the exchanger of this invention very useful.

Desirably, the thin film-like porous material useful in this invention is formed of an organic polymeric material. Preferably, such an organic polymeric material can be washed with water in view of the objects of this invention. In other words, suitable organic polymeric materials for use in this invention are substantially free from dissolution, swelling, breakage, stretching, a reduction in heat and moisture exchangeability, etc. even when washed with cold or hot water or with detergents.

Examples of such organic polymeric materials include olefin or diene polymers such as polyethylene, polypropylene, polystyrene, poly(methyl methacrylate), polyvinyl chloride, polyacrylonitrile and polybutadiene; fluorocarbon polymers such as polytetrafluoroethylene and polyvinylidene fluoride; polyamides such as 6-nylon, 6,6-nylon, 11-nylon, 12-nylon and poly(m-phenylene isophthalamide); polyesters such as polyethylene terephthalate, polybutylene terephthalate, polyarylates and polycarbonate; and other polymers such as polyether sulfone, polysulfone, polypyromellitimide, unsaturated polyesters, cellulose and cellulose acetates. These polymeric materials can be used either singly or as a mixture or in the form of a copolymer. Some water-soluble polymers such as polyvinyl alcohol which are insolubilized by acetalization or crosslinking may also be used. Among the above-exemplified organic polymeric materials, hydrophobic polymers such as polypropylene, polyvinyl chloride and various polyesters, and hydrophilic polymers such as various polyamides, cellulose acetate and cellulose are preferred.

The thin film-like porous material used in this invention can be prepared from these organic polymeric materials by various known methods such as a method involving decomposition of a blowing agent, a method involving volatilization of a solvent, a method involving polycondensation and foaming, a dissolving method, an extraction method, a method involving blowing of a pressurized gas, an emulsion method, a radiation method, or a stretching method. According to the dissolving method or extraction method, the thin film-like porous material having the four properties described hereinabove can be produced with relative ease.

In addition to the aforesaid methods, the following method discovered by the present inventors can also afford the thin film-like porous material used in this invention.

Specifically, this method comprises impregnating a multilayered structure of fibrous web formed mainly of a known thermoplastic polymer with an organic compound, for example a higher alcohol such as lauryl alcohol, a higher fatty acid-type surfactant such as sodium oleate, an n-paraffin, a polyalkylene glycol, or a polymer such as polystyrene or polyacrylates; compressing the impregnated structure under heat; and then removing the organic compound from the resulting structure by using a solvent such as water, an aqueous solution of sodium hydroxide, methanol, acetone, acetic acid, formic acid, propionic acid, dimethylformamide, dimethylacetamide, hexane, heptane, toluene, chloroform and methylene chloride.

Known thermoplastic polymers include, for example, polyolefins such as polyethylene, polypropylene or polystyrene, various polyamides, various polyesters, and various polyurethans. These polymers can be used either singly or as a mixture. It is especially preferable to use a mixture of at least two polymers having different melting points so as to cause a lower-melting polymer to contribute to the formation of pores, and a higher melting polymer, to strength retention.

The fibrous web is a woven or nonwoven fabric composed of an assembly of short fibers or long fibers, or a fibrous assembly obtained by spreading a film-like material having numerous discontinuous cracks in the longitudinal direction, such as a card web or filament web.

According to the above method, the fibers are easier of movement by the viscosity of the organic additive than in the case of simply compressing a multilayered structure of fibrous web under heat. Consequently, a multilayered structure having uniformly distributed fibers can be obtained. Furthermore, the presence of the organic additive prevents adhesion of fused fibers to one another. Extraction of the organic additive with a solvent results in the formation of uniform fine pores.

A thin film-like porous material of a polyolefin may also be prepared by a method which comprises molding a molten mixture consisting of, for example, 10 to 80 parts by weight of preferably 20 to 60 parts by weight, of paraffin and 90 to 20 parts by weight, preferably 80 to 40 parts by weight, of the polyolefin into a film form, and extracting the paraffin with a solvent.

The polyolefin includes, for example, polyethylene, polypropylene, polystyrene, poly-4-methylpentene-1, polybutene, and copolymers of monomers constituting these polyolefins. These polyolefins can be used either singly or as a mixture. Polyethylene, polypropylene, ethylene copolymers, and propylene copolymers are especially preferred.

The paraffin has a melting point of preferably 30° to 100° C., more preferably 35° to 80° C. Preferably, the melting point of the paraffin is relatively low because of the ease of extraction with a solvent. If the melting point of the paraffin is too low, it may lead to the occurrence of bubbles at the time of melting. Hence, paraffins having the aforesaid melting range are used.

Normally liquid aliphatic, alicyclic or aromatic hydrocarbons such as heptane, hexane, cyclohexane, ligroin, toluene, xylene and chloroform, and halogenated products thereof are preferred as the solvent.

The paraffin and the polyolefin are heated to a temperature above the melting point of the polyolefin in an ordinary extrusion molding machine for example, and melted and mixed. The molten mixture is extruded in film form from a die, and cooled with water or air, preferably with water. Electron microscopic examination shows that the resulting film-like material has a sea-and-island structure.

A thin film-like porous material made from a polyamide has a number of small pores and therefore had a high surface area which tends to result in a degraded surface. It is necessary therefore to prevent such surface degradation.

The thin film-like porous material of polyamide in accordance with the present invention is prepared, for example, by dissolving a polyamide in a solution of calcium chloride in a lower alcohol such as methanol which also contains cuprous chloride dissolved therein, forming the solution into a film, and washing and drying the product. Cuprous chloride is contained in the resulting porous material prevents the acceleration of degradation of the polyamide by the remaining calcium chloride, and prevents the aforesaid surface degradation.

A thin film-like reinforced porous material composed of an interlayer of a fibrous web and two surface layers of polyamide can be produced by dipping the fibrous web in a pale green polyamide solution containing calcium chloride and cuprous chloride used in the above method, withdrawing it through a slit having a suitable clearance, evaporating the methanol, and washing the web with water.

Polycapramide and polyhexamethylene adipamide are especially preferred as the polyamide because of the ease of availability. Cuprous chloride is used in an amount of at least 10 moles, preferably 1.5 to 5 moles, per mole of calcium chloride remaining in the resulting thin film-like porous material.

A fire retardant, a coloring agent, a dye, a water repellent, etc. may be added to the polymer constituting the thin film-like porous material in accordance with this invention depending upon the end use. For adsorption of special gases, an adsorbent such as activated carbon may be added.

In the heat-and-moisture exchanger of this invention, the aforesaid thin film-like porous material is incorporated as a partitioning element for two gases to be exchanged.

The porous material as a partitioning element is used in such a form as a flat sheet, a corrugated sheet, a tube, or a hollow filament.

When it is in a flat or corrugated shape, two gases to be exchanged are contacted with both surfaces of the porous material. When it is in a tubular form or in the form of a hallow filament, two gases to be exchanged are passed inwardly and outwardly of the tube or hollow filament.

The porous material having such a form is built in the exchanger of this invention as a partitioning element in the following manner, for example.

Flat porous materials are stacked at predetermined intervals using spacers so that two exchanging gases flow interposing each film-like porous material therebetween. In this structure, the directions of flow of the two gases may cross each other (for example, at right angles to each other), or they may be countercurrent or concurrent. FIG. 1-1 shows one example of a part of a heat-and-moisture exchanger in which thin film-like porous materials 1 and corrugated spacers 2 are superimposed alternately so that the corrugated patterns of the spaces cross each other at right angles. This heat-and-moisture exchanger is a typical example of the type in which two gases to be exchanged flow at right angles to each other with the heat-and-moisture exchange membranes therebetween.

Figures 1, 2:
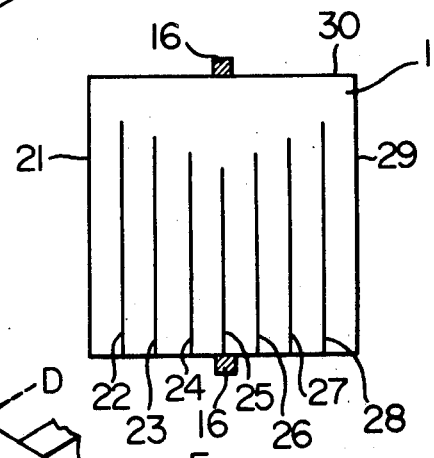

FIG. 1-2 is a schematic view of a heat-and-moisture exchanger of the type in which two exchanging gases flow countercurrent or concurrent with the heat-and-moisture exchanging membrane therebetween. FIG. 1-2 are a plan view of the individual elements constituting the heat-and-moisture exchanger, and FIG. 1-3 is a perspective view of a heat-and-moisture exchanger built by assembling these constituent elements.

In FIG. 1-2, the three sides of porous material 1 are surrounded by partitioning plates 21, 30 and 29. Furthermore, partitioning plates 22, 23, 24, 25, 26, 27 and 28 which are progressively shorter toward the center are provided on the surface of the porous material so as to secure a passage for wind. These partitioning plates have the same height, and are designed such that the direction of flow of airs become countercurrent with the central partitioning plate 25 as a boundary. The reference numeral 16 designates a position differentiating the outside and the inside of a room. The number of partitioning plates for securing air passages is optionally determined.

Figures 1, 2, 3:
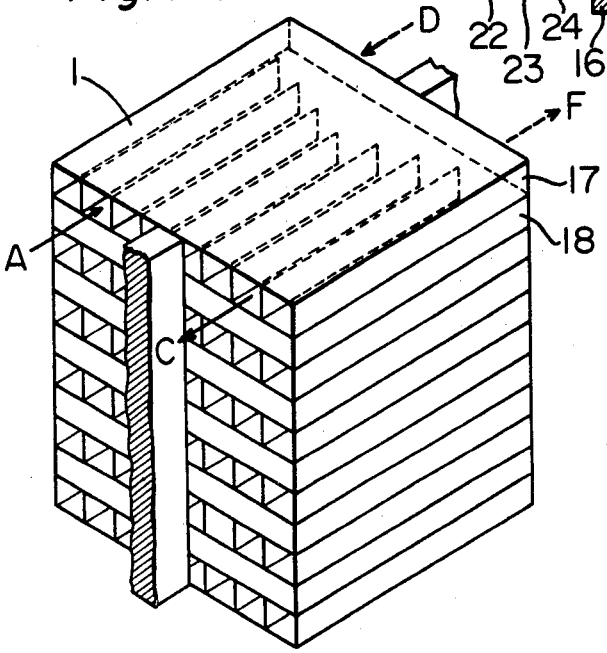
Figure 2:
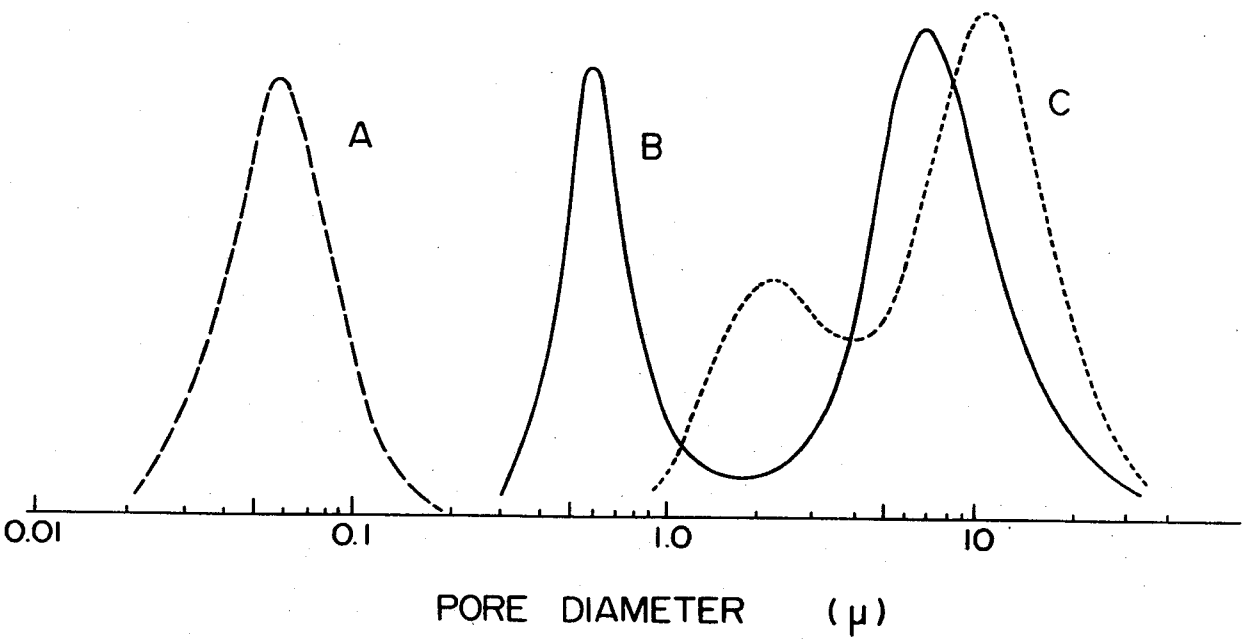
Figure 3:
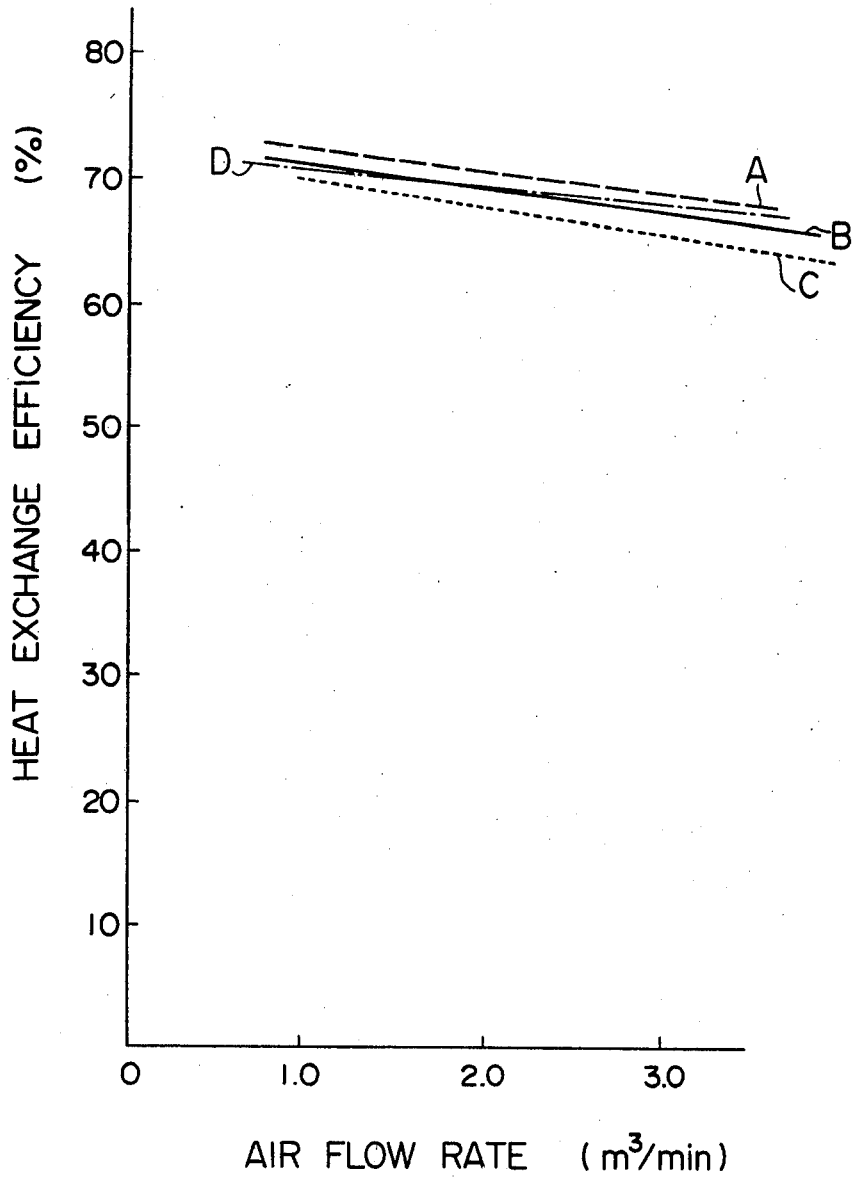

In FIG. 1-3, elements of the type shown in FIG. 1-2 are stacked in directions alternately differing from each other by 180°. For example, in an element 17, air comes from the direction A and is discharged in the direction C, and in an adjacent element 18, air comes from the direction D and is discharged in the direction F (countercurrent). In this case, it is possible to permit entry of air from the direction D and its discharge in the direction D in the element 18 (concurrent). The airs flowing through the elements 17 and 18 are exchanged by the thin film-like porous material 1.

By fixing the porous materials and the spacers or partitioning plates by a bonding agent or the like, a heat-and-moisture exchanger can be obtained in which the thin film-like porous materials are not displaced by air passage or washing, and therefore is free from troubles in movement or washing during movement or washing.

For replacement or washing, the thin film-like porous material should be incorporated detachably, and it is preferable therefore to fix the entire exchanger by, for example, a metallic frame.

The amount of the thin film-like porous material used for heat-and-moisture exchange in this invention differs according, for example, to the volumes of the exchanging gases and the desired rates of exchange. The thin film-like porous material in accordance with this invention exhibits good heat and moisture exchanging properties even when the flow rates of gases to be exchanged are varied. Thus, it exhibits especially desirable properties when it is desired to achieve heat and moisture exchange rapidly.

The heat-and-moisture exchanger of this invention is used as an air-conditioning machine or a ventilating device which involves exchanges of heat and moisture.

In the present application, the ventilating device denotes a device in which exchange of the indoor air with the outdoor air is performed directly through the heat-and-moisture exchanger of this invention. The air-conditioning machine denotes the one which includes its own heat exchanger in addition to the heat-and-moisture exchanger of this invention. The air-conditioning machine has such a structure that a part of the air heat-exchanged by the heat-exchanger flows into the heat-and-moisture exchanger.

Figure 11:
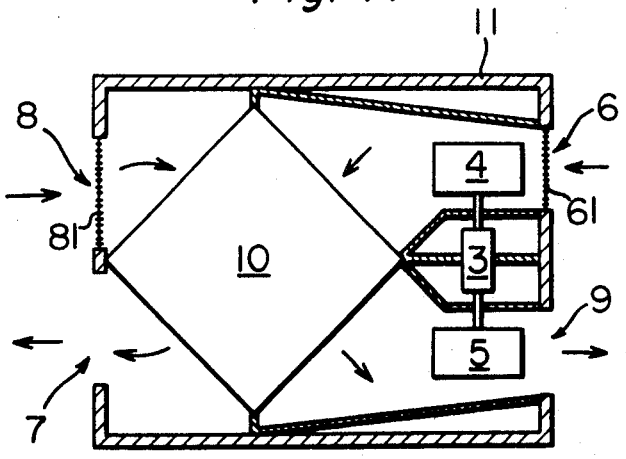

FIG. 11 of the accompanying drawings schematially shows one example of a ventilating device 11 including the heat-and-moisture exchanger of this invention.

In FIG. 11, the reference numeral 10 represents the heat-and-moisture exchanger of this invention in which the thin film-like porous materials are supported by spacers so that two exchange gases flow at right angles to each other as shown in FIG. 1. The outdoor air is taken indoors by a fan 4 connected to a motor 3 through a filter 61 at an air intake port 6 outwardly of a room. It passes through the heat-and-moisture exchanger 10 and enters the room through an air outlet port 7. In the meanwhile, the indoor air is discharged outdoors through an air discharge port 9 via the heat-and-moisture exchanger 10 by means of a fan 5 connected to the motor 3 through a filter 81 at an air intake port 8 located inwardly of the room. In the heat-and-moisture exchanger 10, moisture and heat are exchanged between the indoor air and the outdoor air through the thin film-like porous materials incorporated in it. Accordingly, passages for the indoor air and the outdoor air should be clearly distinguished from each other so that before or after passage through the heat-and-moisture exchanger, the indoor air and the outdoor air may not directly contact each other and get mixed.

The ventilation device in accordance with this invention consists of the heat-and-moisture exchanger of this invention, intake and outlet ports and a passage for the indoor air and a fan for continuously securing the flow of the indoor air through the heat-and-moisture exchanger, and intake and outlet ports and a passage for the outdoor air and a fan for continuously securing the flow of the outdoor air through the heat-and-moisture exchanger. The indoor air and the outdoor air are clearly distinguished from each other by the flow passages, and do not get mixed directly.

Generally, it is rare that a room to be ventilated is a completely closed system, and therefore, it is preferable to mount two fans as mentioned above. When the room is completely or nearly closed, it may be permissible to provide one fan in either one of the air passages. The position of mounting the fans may be at the front or rear side of the heat-and-moisture exchanger. For example, it may be provided before the heat-and-moisture exchanger in both air passages.

Figure 12:
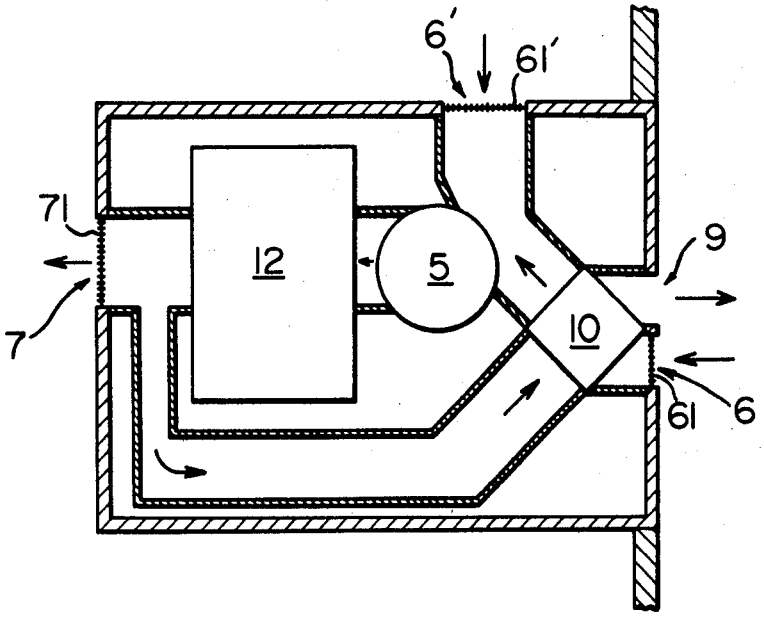

FIG. 12 of the accompanying drawings schematically shows one example of an air-conditioning machine including the heat-and-moisture exchanger of this invention.

The characteristic of the air-conditioning machine is that it is designed such that an air intake port 6′ is provided also on the indoor side, and the air current after passage through a heat exchanger 12 is taken out from an air intake port 7 on the indoor side, and partly flows into the heat-and-moisture exchanger.

In FIG. 12, the reference numeral 10 represents the heat-and-moisture exchanger of this invention. The outdoor air is taken indoors by a fan 5 connected to a motor (not shown) through a filter 61 at an air intake port 6 on the outdoor side, and then passes through the heat-and-moisture exchanger 10. In the meantime, the indoor air taken by a fan 5 through a filter 61′ at an air intake port 6′ on the indoor side is mixed with the air which has passed through the heat-and-moisture exchanger. The mixed air is led to the heat exchanger and either cooled or heated. The air which has left the heat exchanger 12 is partly returned indoors, and partly discharged from a discharge port via the heat-and-moisture exchanger 10.

The air-conditioning machine in accordance with this invention, as described hereinabove, comprises the heat-and-moisture exchanger, a fan for taking the outdoor and indoor airs and passing them through a heat exchanger, a heat exchanger, an element for dividing the air current after passage through the heat exchanger, an outdoor air intake port, and a passage for continuously securing the flow of the outdoor air via the heat-and-moisture, and an outlet port and, an exhaust port and a passage for continuously taking out the divided air stream and continuously discharging it through the heat-and-moisture exchanger. Hence, the divided air stream and the taken outdoor air do not directly get mixed.

The heat exchanger is located at a position through which a mixture of the outdoor and indoor air passes, and the fan may be positioned either before or after the heat exchanger. For example, it is possible to position the fan at the rear of the heat exchanger at which position the air current is divided. In this case, the fan itself may have the function of dividing an air current.

The ventilating device and the air-conditioning machine described above are already known, and are described, for example, in U.S. Pat. Nos. 4,051,898 and 3,666,007.

Thus, the heat-and-moisture exchanger of this invention can perform exchanges of moisture and heat with better efficiencies than the one including paper as an exchanger. It also has a low permeability to toxic gases such as carbon monoxide and carbon dioxide. Accordingly, the exchanger of this invention can be used widely for ventilating and air-conditioning purposes not only in general residential buildings, but also in industrial and commercial buildings, hospital rooms, and transportation facilities such as automobiles, railway trains, and ships. Furthermore, because the heat-and-moisture exchanger can be washed with water, it may be applied to ventilating devices in kitchens or in workshops where mists of oils or organic matter are likely to be generated. Or it can also be used for ventilating bath rooms or agricultural houses because the heat-and-moisture exchanger of this invention can retain its shape at a high humidity.

The heat-and-moisture exchanger of this invention is characterized in that even when the amounts of gases to be exchanged are increased, its efficiencies of heat and moisture exchange can be maintained at a high level. Accordingly, it can be used, for example, as a central ventilating apparatus in commercial buildings which require large quantities of air. In addition, since the heat-and-moisture exchanger of this invention includes a porous partitioning element, it is soundproof, and ventilation can be performed while shutting outdoor noises. Thus, even when no cooler or heater is used, the heat-and-moisture exchanger of this invention can be used as a ventilating device having soundproofing properties.

The various properties of the thin film-like porous material and heat-and-moisture exchanger in this invention are measured by the following methods.

(1) Specific surface area

Measured by a ¢SORPEDMETER MODEL 212D" of Parkin Elmer Company. The theory of measurement is that a monomolecular film of nitrogen is formed adsorbed to the surface of a specimen, the amount of the adsorbed nitrogen is measured, and the specific surface area of the specimen is calculated from the amount of the nitrogen.

A specific procedure for the measurement is as follows:

Nitrogen is passed at a fixed flow rate within the range of 5 to 10 liters/min. through a sample tube containing 0.1 to 0.5 g of the specimen accurately weighed. At the same time, helium is passed through the tube at a fixed flow rate within the range of 25 to 28 liters/min. In this state, the sample tube is dipped in liquid nitrogen and cooled. As a result, nitrogen is adsorbed to the surface of the specimen to form a monomolecular film of nitrogen adsorbed thereto. Then, the sample tube is taken out of the liquid nitrogen, and heated to room temperature to liberate the adsorbed nitrogen gas. The volume of the liberated nitrogen gas is measured.

The measurement of the volume is performed by a detector based on a heat conductivity cell. The measured volume is recorded as a peak area on a record paper.

In the meantime, 0.374 ml of nitrogen gas is passed through a standard vessel attached to the detector and adapted to receive the same volume of nitrogen gas as above, and a peak corresponding to this volume is recorded on the record paper. The volume of nitrogen adsorbed to the specimen is calculated from the ratio of areas of these peaks.

It is ascertained that the area of the specimen which is covered with one milliliter of nitrogen in the form of an adsorbed monomolecular film at the temperature of liquid nitrogen is 4.384 $m^2$. Thus, the surface area of the specimen is calculated by multiplying the volume of the nitrogen calculated as above by this figure.

The result is expressed as a surface area per unit weight, i.e. specific surface area ($m^2/g$).

(2) Measurement of the pore size distribution

Measured by a "POROSIMETER TYPE 60,000" of American Instrument Company. The theory of measurement is that as the pore size is smaller, the pressure required to fill mercury in the pore should be made higher.

Generally, the following relation is established between the pressure and the diameter of a pore.

$$P \cdot D = -4 \cdot \phi \cdot \cos \theta$$

P: the pressure of mercury at the opening part of the pore,

D: the diameter of the pore $\phi$: the surface tension of mercury $\theta$: the contact angle In the measuring instrument used, the following equation (1) holds assuming that the surface tension ($\phi$) of mercury is 473 dynes/cm, and the average contact angle ($\theta$) is 130° .

$$D = 173/P \quad (1)$$

The unit of D is $\mu$, and the unit of P is psia.

By substituting the measured pressure for P in the equation (1), the diameter (D) of the pore is calculated.

A specific measuring procedure is as follows:

The opening part of a small-diameter tube of the measuring instrument is dipped in mercury, and then air is put into the pressure vessel to increase the pressure inside the pressure vessel gradually. Mercury passes onto the vessel through the tube. When the pressure is elevated to 5.8 psi, the opening part of the tube is removed from mercury. When the pressure is again elevated thereafter, mercury of the tube is seen to decrease every time mercury is filled in the pores of the sample. The pressure and the amount of decrease of mercury at this time are measured. The measured pressure is substituted for P in equation (1), and the diameter (D) of the pore is calculated. The amount of the pores having the calculated pore size is recorded as the amount of decrease of mercury. The above procedure is for the measurement of pore sizes in a low pressure region up to 1 atmosphere, and pores having a pore size of 100 to 12 microns can be measured.

Pores having a pore size of less than 12 microns can be measured at a pressure higher than 1 atmosphere. The measuring vessel used in the low pressure resin is directly transferred into a high-pressure region measuring vessel filled with oil. When the oil pressure is exerted, mercury gets into the pore, and the amount of mercury in the tube decreases. The amount of decrease of mercury can be measured electrically as the amount of a variation in electrostatic capacity. Thus, in the high pressure region, too, the amount of pores having a certain diameter can be measured.

By combining the results obtained in the low-pressure and high-pressure regions, the pore size distribution can be determined.

FIG. 2 of the accompanying drawings represents the distribution of the pore size of a thin film-like porous material measured in the above manner.

(3) Value of gas permeability

Measured in accordance with the "Testing Method for Gas Permeability of Paper and Paper Boards" stipulated in Japanese Industrial Standards, JIS P8117-1963.

The measuring method used is "DENSOMETER, GURLEY TYPE, MODEL B".

This device consists of an outer cylinder and an inner cylinder having a closed top and adapted to slide freely inside the outer cylinder in the vertical direction. The space between the outer and inner cylinders is filled with an oil, and when the inner cylinder descends, the air inside comes out from the bottom of the outer cylinder. The bottom of the outer cylinder is a circular hole with an area of 645.16 $mm^2$. In measuring the value of gas permeability, the specimen is placed so as to close the circular hole, and the inner cylinder having a weight of 567 g is allowed to descend by its own weight, and the time required for the air (100 cc) inside the cylinder to be discharged outside past the specimen is measured.

The time in seconds so measured is defined as the value of gas permeability (seconds/100 cc).

(4) Moisture permeability

Measured in accordance with the "Testing Method for Moisture Permeability of Moisture-Proof Packaging Materials" stipulated in Japanese Industrial Standards, JIS Z0208-1953.

The measuring procedure is as follows:

Dried calcium chloride is placed in a moisture-permeable cup made of aluminum, and to the mouth of the cup is attached a test specimen larger than the cup mouth. A frame having the same size as the cup mouth is placed on it, and molten wax is poured outside the frame so as to expose a certain area (28.26 $cm^2$) of the test specimen which is the same in area as the mouth of the cup. In other words, the test specimen is so fixed that steam does not come into and out of the cup except through the test specimen.

The moisture cup so constructed is then placed in an atmosphere kept constant at a temperature of 40°±1° C. and a relative humidity of 90+2%. At predetermined time intervals, the weight increase of the cup is weighed. When there is no further weight increase, the moisture permeability of the specimen is calculated from the weight increase in accordance with the following equation.

$$\text{Moisture permeability } (g/m^2.hr) = M/A \cdot t$$

M: the weight (g) of the cup which increased during t hours

A: the surface area ($m^2$) of the test specimen t: the measuring time (hr)

(5) Ratio of movement of carbon dioxide and carbon monoxide

Air containing about 5% of carbon dioxide (air 1) is passed at a flow rate of 3 liters/min. through one surface of a thin film-like porous material in a square shape with one side measuring 5 cm, and air containing about 0.03% of carbon dioxide (air 2) is passed at the same flow rate through the other surface of the porous material. The concentration of carbon dioxide of the air 2 which has passed through the porous material is measured by gas chromatography, and the ratio of movement of carbon dioxide gas is calculated from the following equation.

$$\text{Ratio of movement of carbon dioxide} = \frac{\left(\begin{array}{c}\text{Concentration}\\ \text{of carbon}\\ \text{dioxide of air}\\ \text{2 at the exit}\end{array}\right) - \left(\begin{array}{c}\text{Concentration}\\ \text{of carbon}\\ \text{dioxide in air}\\ \text{2 at the inlet}\end{array}\right)}{\left(\begin{array}{c}\text{Concentration of carbon}\\ \text{dioxide in air 1}\end{array}\right)} \times 100$$

The ratio of movement of carbon monoxide is measured in the same way as above using carbon monoxide instead of carbon dioxide.

(6) Measurement of exchange efficiencies

A heat-and-moisture exchanger (for example, the one illustrated in FIG. 1) is assembled using the thin film-like porous material in accordance with this invention. Air (corresponding to outdoor air) having a specified temperature ($tO_1$) and a specified humidity ($hO_1$), and air (corresponding to indoor air) having a specified temperature ($ti_1$) and a specified humidity ($hi_1$) are passed through the exchanger at a fixed flow rate so as to perform heat and moisture exchange in the exchanger. The temperature ($tO_2$) and the humidity ($hO_2$) of the air corresponding to the outdoor air which has passed through the heat-and-moisture exchanger are measured. The exchange efficiencies are calculated in accordance with the following equations.

$$\text{Efficiency of heat exchange } (\%) = \frac{(tO_1 - tO_2)}{(tO_1 - ti_1)} \times 100$$

$$\text{Efficiency of moisture exchange } (\%) = \frac{(hO_1 - hO_2)}{(hO_1 - hi_1)} \times 100$$

Let the enthalpy of air having a temperature $tO_1$ and a humidity of $hO_1$ be $Ho_1$ and the enthalpies of airs having other temperatures and humidities be $Ho_2$ and $Hi_1$. then the efficiency of enthalpy exchange is given by the following equation.

$$\text{Efficiency of enthalpy exchange } (\%) = \frac{(Ho_1 - Ho_2)}{(Ho_1 - Hi_1)} \times 100$$

The following examples illustrate the present invention in more detail. In these examples, all parts are by weight.

EXAMPLE 1

A polypropylene film ("Celgard", a trademark for a product of Celanese Corporation) obtained by cold stretching and hot stretching a polypropylene film was used as a thin film-like porous material for a heat-and-moisture exchanger. The film had the following properties.

Thickness: 24 microns
Specific surface area: 6.57 $m^2/g$
Gas permeability value: 996 seconds/100 cc
Pore size distribution: 0.2–0.02 micron
Moisture permeability: 100.5 $g/m^2.hr$
Ratio of movement of carbon dioxide: 8.0% (flow rate: 3 liters/min.)

Curve A in FIG. 2 shows the pore size distribution of the above thin film-like porous material.

When the surface of the resulting thin film-like porous material was examined by an electron photomicrograph, pores with a size of more than 1 micron could not be observed. The thin film-like polypropylene porous material was cut into squares with each side measuring 13 cm. Each of the square films was bonded to a spacer of a corrugated polyethylene sheet with a height of about 2.8 mm and a pitch of 5.5 mm by a vinyl acetate-type adhesive. 146 such bonded assemblies were stacked so that the corrugated sheet of one assembly formed an angle of 90° with the corrugated sheet of the next assembly to build a module for heat-and-moisture exchange, as shown in FIG. 1-1. In FIG. 1, the reference numeral 1 represents the thin film-like porous body material, and the reference numeral 2 represents the spacer.

Using a heat-and-moisture exchange including this module, air at a temperature of 32° to 34° C. and a humidity of 79 to 75% corresponding to the outdoor air and air at a temperature of 23° to 24° C. and a humidity of 60 to 65% corresponding to the indoor air were passed at the same flow rate at right angles to each other, and the exchange efficiencies were measured.

Figure 4:
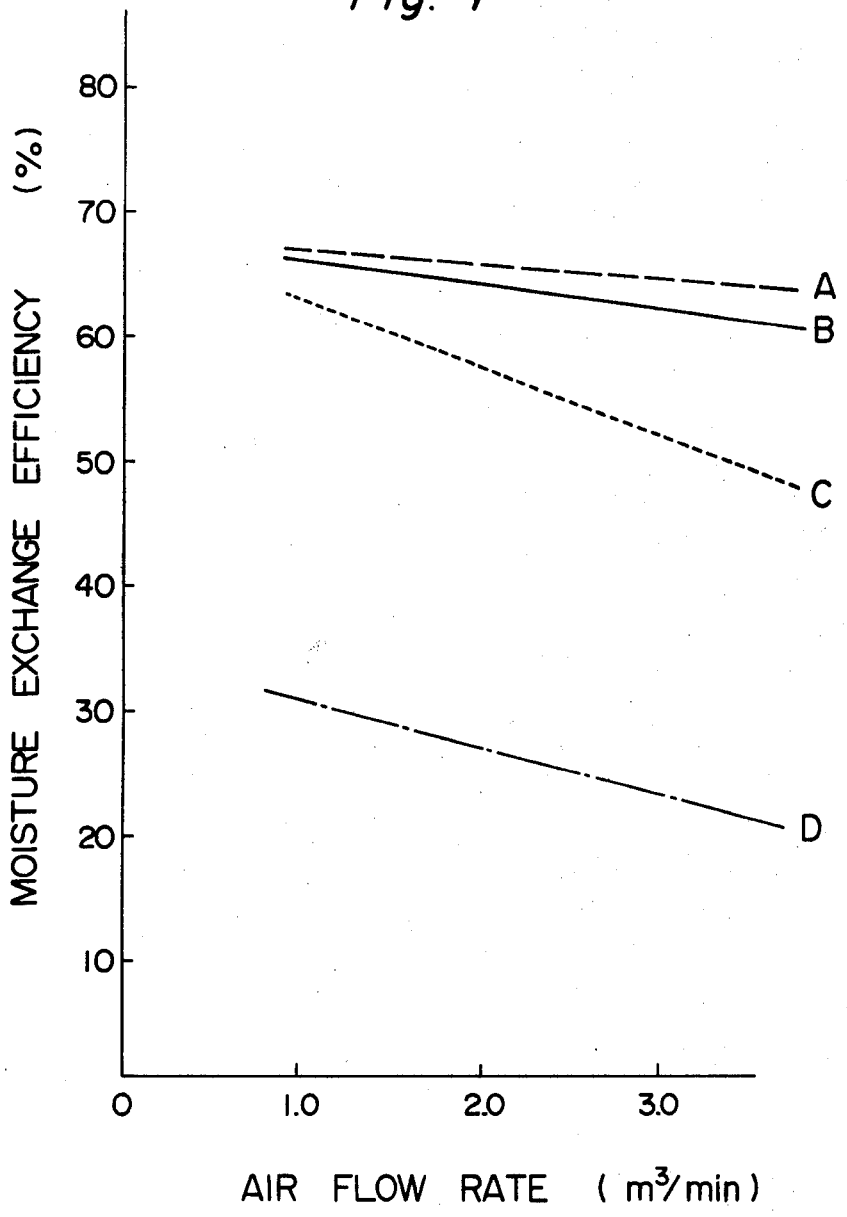
Figure 5:
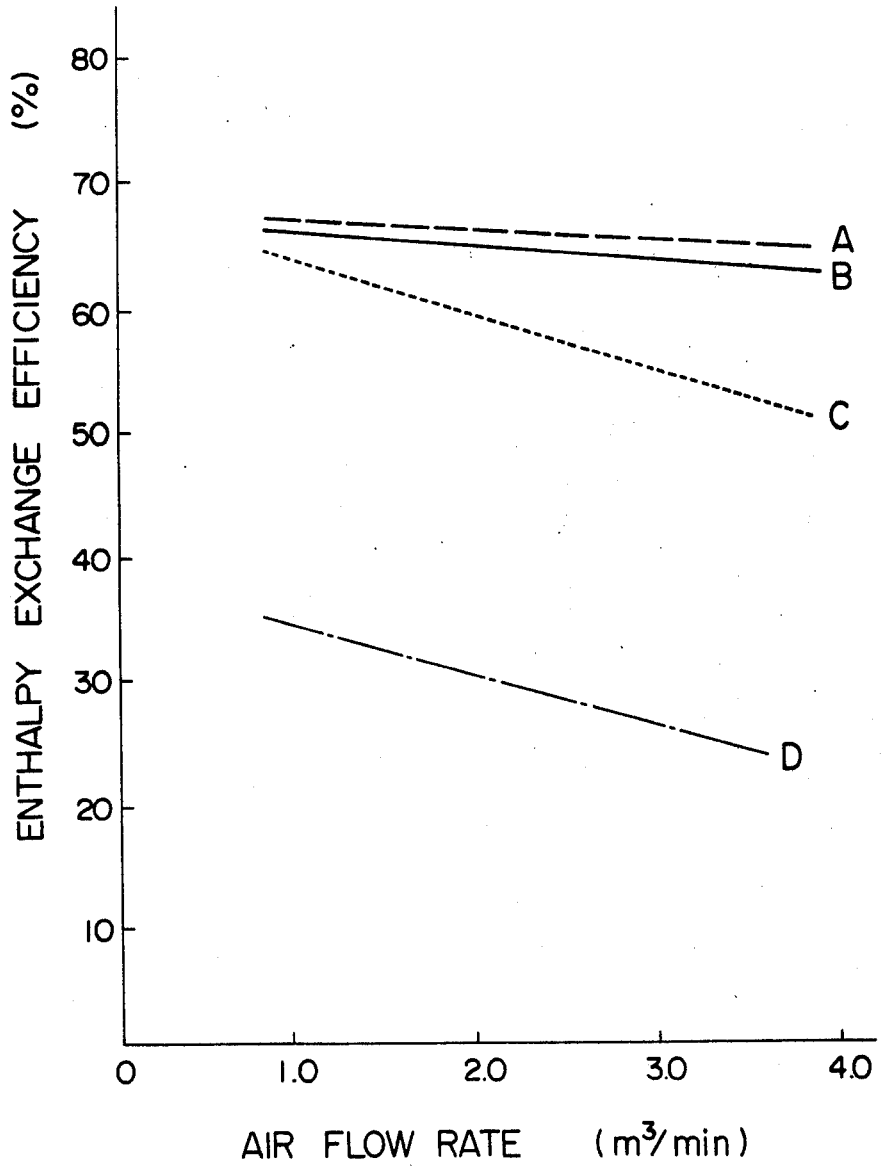

The results are shown in FIGS. 3, 4 and 5. In these figures, straight line A represents the results obtained above. In these figures, the abscissa represents the flow rate of air ($m^3$/min.), and the ordinates represent the efficiency of heat exchange, the efficiency of moisture exchange, and the efficiency of enthalpy exchange, respectively.

The heat-and-moisture exchanger was washed with water at 40° C. containing a neutral detergent, and then dried. It could be dried within a time as short as 2 to 3 hours, and no change in shape occurred.

When the exchange efficiencies were measured on the washed heat-and-moisture exchanger, they were found to be the same as those before washing.

EXAMPLE 2

Forty parts of calcium chloride was dissolved in 125 parts of methanol, and 19 parts of polycapramide was added. The mixture was heated to form a solution, and 0.1 part of cuprous chloride was added as a stabilizer.

A polyester nonwoven fabric having a thickness of 60 microns ("UNICEL", trademark for a product of Teijin Limited) was dipped in the resulting solution, and pulled up through a slit with a width of 500 microns. A part of the methanol was evaporated, and the fabric was dipped in water to remove the remaining methanol and calcium chloride to afford a reinforced polymeric porous material. The properties of the polymeric porous material were as follows:

Thickness: 93 microns
Specific surface area: 0.815 $m^2/g$
Gas permeability value: 325 seconds/100 cc
Pore size distribution: 20–2 microns, 2–0.3 micron
Moisture permeability: 97.0 $g/m^2.hr$
Ratio of movement of carbon dioxide: 9.3% (flow rate 3 liters/min)

Curve B in FIG. 2 of the accompanying drawings shows the pore size distribution of the thin film-like porous material.

Figure 6:
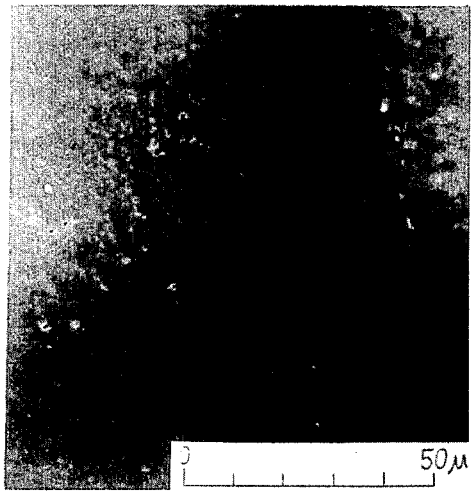
Figure 7:
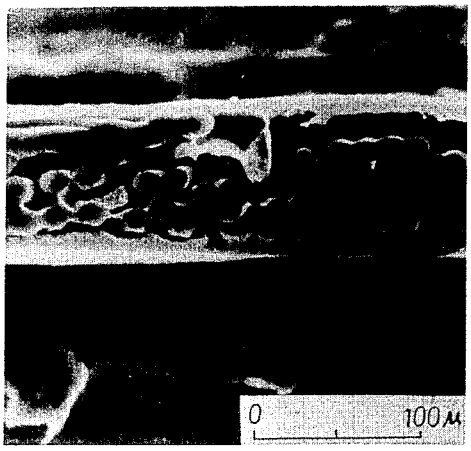

The electron microphotographs of the polymeric porous material are shown in FIGS. 6 and 7. FIG. 6 is an electron microphotograph of its surface, and FIG. 7 is an electron microphotograph of its cross section.

A point with a black center and a whitish periphery which is seen in FIG. 6 is a relatively large pore among the photographed pores although its size is less than 1 micron. A band of about 100 microns in width which is seen to stretch in the transverse direction roughly at the center of FIG. 7 is an electron microphotograph of the cross section of the polymeric thin film-like porous material. The upper and lower end portions of the aforesaid band seen to be somewhat whitish in the photograph is a thin film layer of nylon containing a number of small pores such as the one seen in FIG. 6, and the central portion of the aforesaid band which is seen to be an assembly of numerous circles having a diameter of about 15 microns is a non-woven fabric layer.

As is seen from the electron photograph of the cross section (FIG. 7), in the polymeric porous material, the nylon layer did not completely adhere to the nonwoven fabric layer, and it was composed of three layers with the nonwoven fabric layer as an interlayer. In the electron microphotograph (FIG. 6) of the surface, pores having a size of more than 1 micron were not observed.

From the electron microphotographs and the results of observation, it was assumed that in the pore size distribution shown by curve B of FIG. 2, the distribution of a larger pore diameter of the two large distributions is that of the pores of the nonwoven fabric and the spaces between the nonwoven fabric and the nylon layer, and the distribution of the smaller one is that of the pores of the nylon layer. The pore size range of the nylon layer was therefore determined to be about 0.3 to 2 microns.

The resulting thin film-like polymeric porous material was cut into squares each side measuring 13 cm, and a heat-and-moisture exchanger was built in the same way as in Example 1. The number of stages stacked was 140.

The exchange efficiencies were measured under the same conditions as in Example 1, and the results are shown in straight line B in FIGS. 3 to 5 of the accompanying drawings.

The heat-and-moisture exchanger was washed with water in the same way as in Example 1. No change occurred in shape nor in properties as a result of washing.

COMPARATIVE EXAMPLE 1

Japanese paper containing 30% of polyvinyl alcohol fibers was used as a thin film-like porous material for heat and moisture exchange. The properties of the paper were as follows:

Thickness: 198 microns
Specific surface area: 0.189 $m^2/g$
Gas permeability value: 63 seconds/100 cc
Pore size distribution: 20 to 1.0 micron
Moisture permeability: 62 $g/m^2.hr$
Ratio of movement of carbon dioxide: 14.2% (flow rate 3 liters/min.)

The pore size distribution of the above porous material is shown in curve C in FIG. 2.

Figure 8:
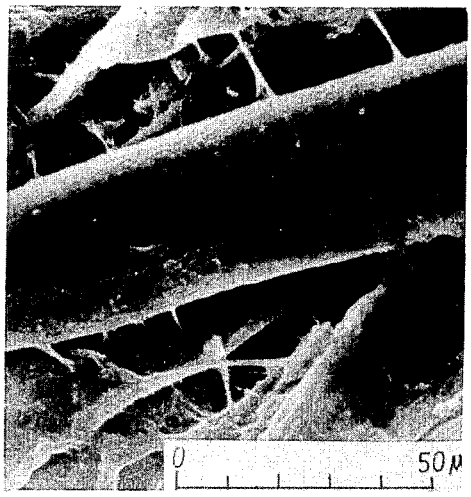
Figure 9:
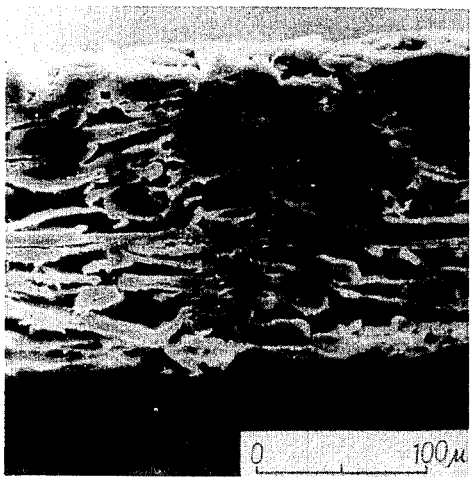

The electron microphotographs of the surface and cross section of this porous material are shown in FIGS. 8 and 9. Using this porous material, a heat-and-moisture exchanger was built in the same way as in Example 1. The number of stages stacked was 141. The proper performances of this heat-and-moisture exchanger were measured, and the results are shown as straight line C in FIGS. 3 to 5.

The results of Comparative Example 1 are compared with the results of Examples 1 and 2. The heat-and-moisture exchangers in Examples 1 and 2 had a larger air permeability than the heat-and-moisture exchanger of Comparative Example 1, and the permeation of air through the thin film-like porous material was more difficult. Despite this, the ability of the exchangers in Examples 1 and 2 to exchange moisture was better, and their dependence of the efficiency of moisture exchange on the flow rate of air was smaller.

The exchanger including Japanese paper as the porous material (Comparative Example 1) showed a moisture exchange efficiency of more than 60% at an air flow rate of 1 $m^3$/min., but it decreases to about 50% when the flow rate increased to 3 $m^3$/min. In contrast, the heat-and-moisture exchangers of Examples 1 and 2 in accordance with this invention, the moisture exchange efficiency of about 65% was obtained within the same range of flow rate variations although a slight decrease in efficiency was noted with increasing flow rate.

Furthermore, the heat-and-moisture exchangers of Examples 1 and 2 were less permeable to air, and to carbon dioxide.

A comparison of the electron microphotographs of FIGS. 8 and 9 with the those of FIGS. 6 and 7 clearly shows that the surface and cross section of the thin film-like porous material of Example 2 (FIGS. 6 and 7) are different in structure from the Japanese paper of Comparative Example 1 (FIGS. 8 and 9).

COMPARATIVE EXAMPLE 2

A porous polycapramide film was prepared in the same way as in Example 2 except that the width of the slit was changed to 300 microns.

Figure 10:
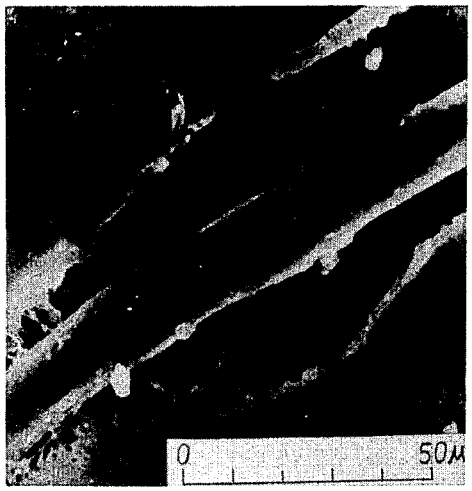

An electron microphotograph of the surface of this film is shown in FIG. 10.

Pores with a size of more than 50 microns are seen in FIG. 10. The band having a diameter of about 15 microns seen in the photograph represents the fibers of the nonwoven fabric.

The nylon film had the following properties.

Specific surface area: 1.067 $m^2/g$

Gas permeability value: 17 seconds/100 cc
Moisture permeability: 97 g/m$^2$.hr

The ratio of movement of carbon dioxide (the flow rate 3 liters/min.) measured actually was 28.4%.

When this porous film was used for ventilation, polluted air was seen to flow back into the air to be taken indoors.

COMPARATIVE EXAMPLE 3

Polycaproamide was melt-extruded to form a uniform film which had the following properties.

Thickness: 44 microns
Gas permeability value: more than 40,000 seconds/100 cc
Ratio of movement of carbon dioxide: nearly 0%

The same heat-and-moisture exchanger was built using this film as a thin film-like porous material. The performances of this exchanger were determined, and the results are shown in straight line D in FIGS. 3 to 5. It is seen that this exchanger showed an extremely low moisture exchange efficiency.

EXAMPLE 3

A mixture composed of 70% by weight of polypropylene, 30% by weight of polycapramide and 1% by weight of talc was melted and kneaded in a vent-type extruder while forcing nitrogen gas into it. The kneaded mixture was extruded from a slit die under the following conditions while blowing out nitrogen gas.

Extrusion temperature: 280° C.
Slit clearance: 0.25 mm
Draft ratio: 110%
Take-up speed: 90 meters/second Thus, cracked sheets were obtained.

A number of these cracked sheets were laminated, and passed between feed rollers. Immediately rearward of the feed rollers were provided a pair of fan-shaped belts, and the laminate was fed to these belts at an overfeed ratio of 20 while holding both ends thereof in position, and extended to 10 times the original dimension in the widthwise direction. The extended web was shaped by a pre-press roller, dipped in a solution consisting of 10 parts of n-paraffin (having a melting point of 50° to 52° C.) and 90 parts of n-hexane, squeezed by squeeze rolls, dried, and heat-treated at 150° to 160° C. and 10 kg/cm$^2$ by being passed through heated rollers.

The heat-treated web was dipped in a solution of n-hexane, washed twice, dried, and wound up to form a thin film-like polymeric porous material having the following properties.

Thickness: 107 microns
Specific surface area: 3.437 m$^2$/g
Gas permeability value: 800 seconds/100 cc
Moisture permeability: 87 g/m$^2$.hr
Pore size distribution: 1.5 to 0.02 micron In an electron microphotograph of the surface of this porous material, pores having a pore size of about 1 micron were observed, but pores having a diameter of more than 2 microns were not observed.

A heat-and-moisture exchanger was built in the same way as in Example 1 using the resulting polymeric porous material, and the exchange efficiencies of the exchanger were measured under the same conditions as in Example 1. The results are shown in Table 1.

EXAMPLE 4

Polysulfone ("UDEL", a trademark for a product of Union Carbide Corporation) and 35% by weight thereof of methyl Cellosolve were dissolved in N-methyl pyrolidone. The solution was cast into a film, washed with water to remove the methyl Celosolve and thereby to form a porous polysulfone film having the following properties.

Thickness: 57 microns
Gas permeability value: 478 seconds/100 cc
Moisture permeability: 91 g/m$^2$.hr
Specific surface area: 1.973 m$^2$/g In an electron microphotograph of the polysulfone film, pores having a diameter of at least 1 micron were not observed.

A heat-and-moisture exchanger was built in the same way as in Example 1 using the polysulfone film. The performances of the exchanger were measured, and the results are shown in Table 1.

EXAMPLE 5

A mixed solution consisting of 20 parts of polyvinyl chloride, 120 parts of tetrahydrofuran, 15 parts of polyethylene glycol having a molecular weight of 3,000 and 200 parts of chloroform was cast into a film. The film was washed with methanol to remove the polyethylene glycol to afford a thin film-like porous material which had a thickness of 53 microns, a gas permeability having a value of 278 seconds/100 cc, a moisture permeability of 73 g/m$^2$.hr, a specific surface area of 1.527 m$^2$/g and a pore size distribution of 1.5 to 0.1 micron.

Using the resulting film, the same heat-and-moisture exchanger as in Example 1 was built, and its exchange efficiencies were measured. The results are shown in Table 1.

TABLE 1

| Example | Exchange efficiencies (%) | | |
|---|---|---|---|
| | Heat | Moisture | Enthalpy |
| 3 | 70 | 61 | 63 |
| 4 | 68 | 63 | 65 |
| 5 | 70 | 59 | 62 |

The exchange efficiencies given in Table 1 were measured at a flow air flow rate of 3 m$^3$/min.

EXAMPLE 6

Air-conditioners (using a cooler as a heat exchanger) of the type schematically shown in FIG. 12 were built using each of the heat-and-moisture exchangers obtained in Examples 1 and 2 and Comparative Examples 1 and 3. These air conditioners were operated, and the results are shown in Table 2 below.

TABLE 2

| Example (Ex.) or Comparative Example (CEx.) | Temperature/humidity | | | | | |
|---|---|---|---|---|---|---|
| | Outdoor air (6 in FIG. 12) | | Discharge air (9 in FIG. 12) | | Air blown indoors (7 in FIG. 12) | |
| | Temperature | Humidity | Temperature | Humidity | Temperature | Humidity |
| Ex. 1 | 33.0 | 0.0221 | 29.2 (68%) | 0.0199 (68%) | 22.8 | 0.0152 |
| Ex. 2 | 32.8 | 0.0220 | 28.7 (62%) | 0.0193 (65%) | 22.0 | 0.0144 |
| CEx. 1 | 33.0 | 0.0221 | 29.0 (60%) | 0.0192 (57%) | 23.0 | 0.0153 |
| CEx. 3 | 33.0 | 0.0221 | 28.8 (57%) | 0.0185 (40%) | 23.2 | 0.0161 |

The flow rate of the outdoor air 6: 1.5 m$^2$/min.
The flow rate of the air 7: 3.5 m$^3$/min.

Humidity: Absolute humidity ($H_2O$ kg/kg of dry air)

The figures in the perentheses show exchange efficiencies (%).

What we claim is:

1. A heat-and-moisture exchanger comprising a thin film-like porous material as a stationary partitioning element for heat and moisture exchanges between two gases separated by said porous material, said porous material containing numerous pores having an average diameter of not more than 5 microns and opened to both surfaces thereof, and having a thickness of not more than 500 microns, a specific surface area of at least 0.3 $m^2/g$, and a gas permeability having a value of at least 100 seconds/100 cc.

2. The heat-and-moisture exchanger of claim 1 wherein said numerous pores opened to both surfaces of said porous material have an average diameter of not more than 2 microns.

3. The heat-and-moisture exchanger of claim 1 wherein said thin film-like porous material has a specific surface area of at least 0.5 $m^2/g$.

4. The heat-and-moisture exchanger of claim 1, 2 or 3 wherein said thin film-like porous material has a thickness of not more than 200 microns.

5. The heat-and-moisture exchanger of claim 1, 2 or 3 wherein said thin film-like porous material is composed of a synthetic or semisynthetic organic polymer.

6. The heat-and-moisture exchanger of claim 1, 2 and 3 wherein said thin film-like porous material consists of two surface layers made of a porous film containing numerous pores having an average diameter of not more than 5 microns and an interlayer made of a reticulated structure containing numerous pores having an average diameter of at least 5 microns, and has a specific surface area of at least 0.3 $m^2/g$ and a gas permeability having a value of at least 100 seconds/100 cc.

7. A ventilating device including the heat-and-moisture exchanger of claim 1.

8. An air-conditioner including a heat exchanger and the heat-and-moisture exchanger of claim 1.

* * * * *